United States Patent [19]

Adams

[11] 4,365,569

[45] Dec. 28, 1982

[54] FEED REGULATOR CLAMP

[75] Inventor: Kenneth D. Adams, Madison, N.J.

[73] Assignee: The Singer Company, Stamford, Conn.

[21] Appl. No.: 194,706

[22] Filed: Oct. 6, 1980

[51] Int. Cl.[3] ..... D05B 27/22

[52] U.S. Cl. ..... 112/315; 112/323

[58] Field of Search ..... 112/315, 314, 317, 323

[56] References Cited

U.S. PATENT DOCUMENTS

| | | | |
|---|---|---|---|
| 3,921,552 | 11/1975 | Daman et al. | 112/323 |
| 4,018,172 | 4/1977 | Ketterer | 112/323 |
| 4,019,450 | 4/1977 | Adams | 112/323 |
| 4,095,540 | 6/1978 | Kaltenbach et al. | 112/315 |
| 4,114,547 | 9/1978 | Russell | 112/315 X |

*Primary Examiner*—H. Hampton Hunter

*Attorney, Agent, or Firm*—Edward P. Schmidt; Robert E. Smith; Edward L. Bell

[57] ABSTRACT

A feed regulator clamp in the shape of a bell crank having the pivot rod thereof retained in a slot in a sewing machine bed by a flat spring which also may serve to urge the clamp into clamping engagement with a feed regulator. A first arm of the bell crank comprising the clamp is for engagement with the feed regulator and a second arm of the bell crank is for engagement with a cam controlling the engagement of the first arm with the feed regulator. The flat spring which retains the clamp to the sewing machine bed urges the first arm into engagement with the feed regulator whenever permitted by the cam which is circular in cross-section except for a flat spot which, when aligned with the second arm, will permit the first arm to come into clamping engagement with the feed regulator.

4 Claims, 6 Drawing Figures

Fig. 1
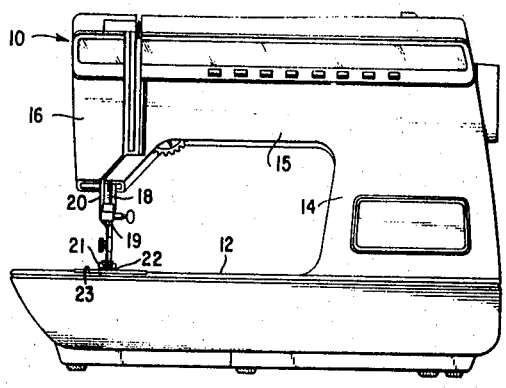
Fig. 3
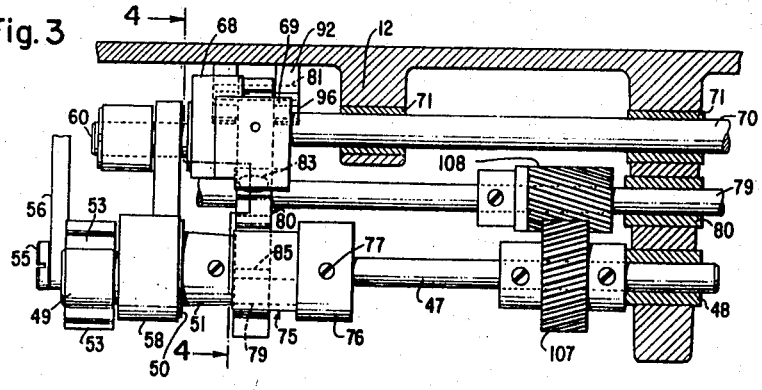
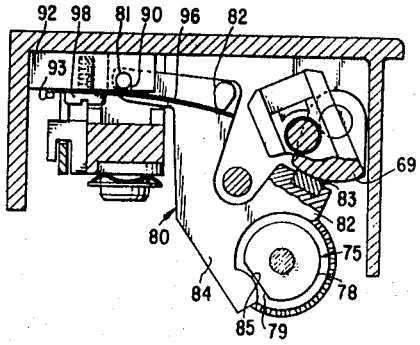
Fig. 4

Fig. 2
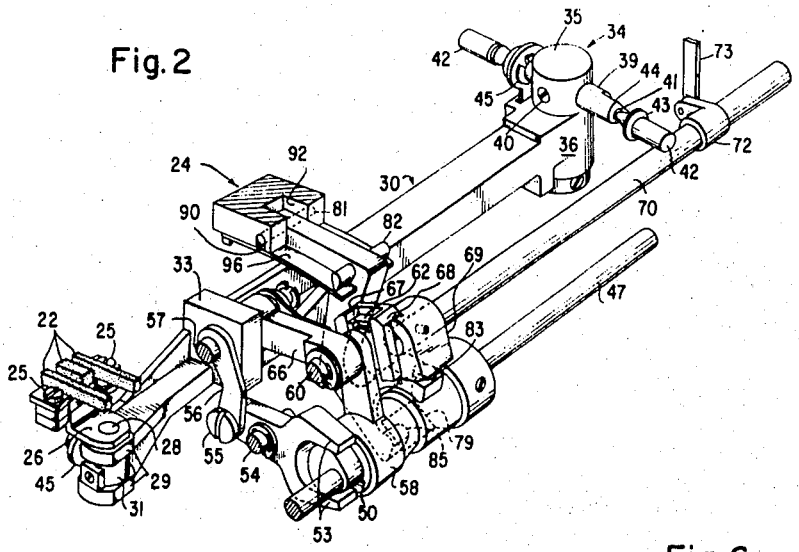
Fig. 6
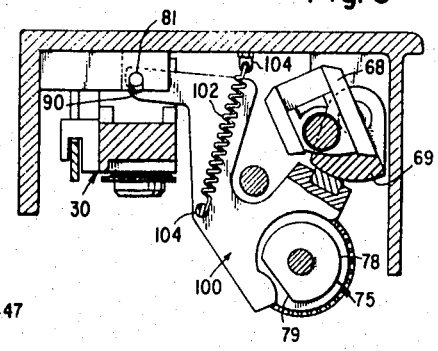
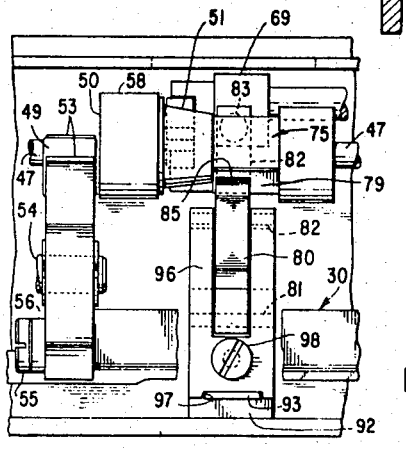
Fig. 5

FEED REGULATOR CLAMP

BACKGROUND OF THE INVENTION

This invention pertains to sewing machines; more particularly, it is concerned with a feed clamping device for retaining the feed regulator of a sewing machine in a fixed position at a time when the feed dogs are in engagement with a work material and urging that work material into a forward or rearwardly motion.

In the prior art there is the U.S. Pat. No. 4,018,172 of Ketterer which discloses a face cam which deflects a clamping plate to create a frictional engagement between a feed regulator and the sewing machine frame in order to inhibit motion thereof during the work material feeding cycle. There is also the U.S. Pat. No. 4,019,450 of Adams which discloses a shiftable member extending between a brake member affixed to the feed regulator shaft and an interposer contacting an eccentric on the feed shaft, arranged so as to hold the feed regulator shaft in a fixed position when the feed dog rises into a work material feeding position. This latter patent also discloses as a second embodiment a bell crank pivoted on a stud fixed to the sewing machine frame to have a first arm thereof forced into engagement with a feed regulator by a second arm thereof. Some difficulties were encountered with these prior art devices. For example, in the patent of Adams, the interposer device required a critical adjustment in order to assure proper operation of the regulator clamp device, which adjustment was subject to change due to wear. The bell crank disclosed in the patent of Adams had no adjustment capability with the result that the bell crank could be a highly stressed part which is also subject to considerable wear. The patent of Ketterer discloses an arrangement which is readily susceptible of erroneous adjustment so as to create an over-stressed condition which could be a problem.

What is required is an arrangement which may be readily assembled and will operate without the wear or over-stress problems found in the prior art.

SUMMARY OF THE INVENTION

The above requirements are found in the invention in which a bell crank is urged by a spring to have a first arm impinge upon a cam having a lower land thereon which allows the bell crank to rotate until the second arm thereof impinges upon a feed regulator. In this arrangement the clamping force is provided by the spring, which clamping force is also the maximum resistance to be overcome by the cam. Adjustment is not required. In a first embodiment, a flat leaf spring serves to hold the pivot axle of the bell crank in molded or cast slots in the sewing machine bed and, simultaneously, to apply a torsional moment to the bell crank for clamping the feed regulator or following the cam. In a second embodiment, a coil spring is substituted for the leaf spring and may perform the same function as the leaf spring in retaining the axle of the bell crank in the sewing machine frame and applying the torsional moment thereto.

DESCRIPTION OF THE DRAWINGS

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings in which:

FIG. 1 is an elevation of a sewing machine in which the invention may be applied;

FIG. 2 is a perspective of the feeding system of the sewing machine shown in FIG. 1 with the invention incorporated therein;

FIG. 3 is a cross-sectional view of a portion of the sewing machine bed shown in FIG. 1 with the feed regulator clamped in place;

FIG. 4 is a view of the feed regulator clamp taken substantially along line 4—4 of FIG. 2;

FIG. 5 is a bottom plan view of the feed regulator clamp to show the arrangement of the leaf spring thereto; and, FIG. 6 is a view corresponding to FIG. 3 of a second embodiment of the invention utilizing a coil spring in place of a leaf spring.

Referring now to FIG. 1, there is shown a sewing machine 10 within which the invention finds utility. The sewing machine 10 includes a bed 12, from one end of which rises a standard 14 supporting a bracket arm 15 and a head portion 16 in overlying relationship to the bed. Supported within the head portion 16 for endwise reciprocation and lateral oscillation by means of instrumentalities not shown but well known in the sewing machine art, is a needle bar 18 terminating in a sewing needle 19. Also supported in the head portion 16 behind the needle bar 18 is a presser bar 20 terminating in a presser foot 21 which is also supported therein by instrumentalities well known in the sewing machine art. Sewing needle 19 cooperates with sewing instrumentalities located within the bed 12 of the sewing machine 10 in the formation of sewing stitches in any manner which is well known in the sewing machine art. The presser foot 21 is urged by any of many well known instrumentalities against a feed dog 22 protruding through slots in a throat plate 23 and part of a feed system supported within the bed 12 of the sewing machine 10.

The usual feed system for a sewing machine 10 as shown in FIG. 1 is a four motion feed in which feeding and return motions are made when the feed dog 22 is in the raised and lowered positions, respectively. It frequently occurs when feeding a heavy work material through a sewing machine 10 that the load on the feeding dog is reflected back through the feeding system to the regulator thereof, causing motion thereof. In order to avoid this problem, feed regulator clamps are utilized which maintain the position of the feed regulator in opposition to a force generated by feeding a heavy work material.

Referring now to FIG. 2 there is shown a feed system 24, one of a variety of possible feed systems which may incorporate the invention. The feed dog 22 is secured by screws 25 to a feed dog carrier 26 which is fixed upon a pivot pin 28 journalled freely in bifurcations 29 formed at one extremity of an elongated feed bar 30. The feed bar 30 extends laterally within the sewing machine bed 12 and at the extremity opposite the bifurcations 29, the feed bar is supported relatively to the bed in gimbals indicated generally at 34.

The gimbals 34 comprise a vertical headed pin 35, on which pin an enlargement 36 formed on the extremity of feed bar 30 is freely journalled. The enlarged head of the vertical pin 35 is formed with a transverse bore accommodating a cylindrical trunnion pin 39 which is sustained by conical seats 41 at both sides of the trunnion engaged by conical pintles 42 slidably disposed in bores of the bed 12.

Thus the feed dog 22 connected to one extremity of the feed bar 30 may undergo up and down pivotal motion about conical pintles 42, and back and forth oscillation about the vertical pin 35 with the enlarged head. Partially visible is an anchor link 45 which extends from a groove in the trunnion pin 39 to the opposite extremity of the feed bar to be connected to a collar 31 affixed to the pivot pin 28. Thus is created a parallelogram arrangement of the anchor link 45 and feed bar 30 which serves to maintain a fore and aft alignment of the feed dog 22 for all positions of oscillation of the feed bar about the vertical pin with the enlarged head 35. Further particulars on the feed system shown may be obtained by reference to the U.S. Pat. No. 3,527,183 assigned to the same assignee as the instant invention, which is hereby incorporated by reference and made a part of this application.

Forward of the feed bar 30 is a feed shaft 47 journalled in bearings 48 (see FIG. 3) within the sewing machine bed 12. At one extremity of the feed shaft 47 is a triangular lift cam 49 and an advanced eccentric 50. The tines 53 of a feed fork 52 span the lift cam 49 to urge a connecting link 56 which is attached to a pin 57 carried by a boss 33 on the feed bar 30. One end of a connecting rod 58 encircles the advance eccentric 50, and the other end of the connecting rod encircles a pin 60 on one extremity of a link 66. The extremity of the link 66 opposite the pin 60 is carried in a ball and socket arrangement (not shown) on the extremity of the pin 57 protruding through the boss 33 of feed bar 30. The pin 60 is also attached to a slide block 62, which slide block 62 is carried in a slot 67 in a feed regulator 68. The feed regulator 68 is carried by a feed regulator shaft 70 journalled in bearing 71 (see FIG. 3) within the sewing machine bed 12 to be actuated by a lever 72 affixed to the feed regulator shaft and the link 73 pivotally connected thereto and extending to manual or automatic actuation means. The feed regulator 68 includes a feed regulator clamp boss 69 having thereon an arcuate clamping surface for a purpose which will be explained below.

In FIG. 3, a partial elevation of the feed system 24 shown in FIG. 2, there is visible the feed regulator shaft 70, and the feed shaft 47 supporting helical gear 107 in mesh with a drive helical gear 108 supported on a hook drive shaft 79 carried by bearings 80 affixed in the bed 12 of the sewing machine 10. A sewing machine hook (not shown) is driven by the hook drive shaft 79 at a speed which is generally twice the rate of reciprocation of the needle bar 18. By a reducing gear mesh the feed shaft 47 is driven at the speed of needle bar reciprocation so as to feed the work material in time with needle movement. Visible on the feed regulator shaft 70 is the feed regulator 68 with the feed regulator clamp boss 69. Visible on the feed shaft 47 is the combination triangular lift cam 49 and advance eccentric 50 which are held attached to the feed shaft by a clamp screw extending through the hub 51 thereof. Adjacent the lift cam 49 and advance eccentric 50, and in line with the feed regulator clamp boss 69, is a clamp actuating cam 75 having a hub portion 76 fixed by a screw 77 to the feed shaft 47. A feed regulator clamp 80 in the shape of a bell crank pivots on a pivot rod 81 thereof arranged in a groove 90 which may be molded, cast or machined in a U-shaped boss 92 formed as part of the bed 12 (see FIGS. 2 through 5). A flat U-shaped spring 96 with elongated legs is fashioned with a relief 97 (see FIG. 5) keyed to a projection 93 extending from the boss 92 and is affixed to the boss by screw 98. A pin 82 extends through the feed regulator clamp 80 spaced from the pivot pin 81, and the flat spring 96 functions to retain the pivot rod 81 of the feed regulator clamp trapped in the groove 90 and to provide a counterclockwise bias as viewed in FIG. 4 upon the feed regulator clamp. The feed regulator clamp 80 is further formed with a first arm 82 having as an insert thereto a clamping surface 83 arranged adjacent the feed regulator clamp boss 69, and a second arm 84 extending adjacent the clamp actuating cam 75. The clamp actuating cam 75, as seen in FIG. 4, comprises a circular arc 78 on approximately 300° of its periphery joined by a chord 79 over the remaining 60°. The flat spring 96 urges a follower portion 85 of the second arm 84 of the feed regulator clamp 80 into engagement with the circular arc 78 of the clamp actuating cam 75. When the clamp actuating cam 75 rotates to where the chord 79 is opposite the follower portion 85, the first arm of the feed regulator clamp 80 is urged towards the feed regulator boss 69 by the flat spring 96 to perform a clamping function on the feed regulator 68. This function would take place while the feed dog 22 was elevated above the throat plate 23 and in engagement with a work material, thereby to deter the possibility of feed back forces rotating the feed regulator clamp 68. At a time when actuation of the feed regulator 68 to a new position may be necessary by actuatation of link 73, the clamp actuating cam has revolved once again to a position where the circular arc 78 impinges upon the follower portion 85 of the second arm 84 and removes the insert 83 in the first arm 82 from engagement with the feed regulator clamp boss 69.

Thus, the feed regulator clamp 80 is retained in a molded, cast or machined groove 90 in the bed 12 of the sewing machine 10 by a flat spring 96, which spring also biases the clamp in a counterclockwise direction as viewed in FIG. 4, the entire assembly being operative without any necessity for any adjustment thereto. Referring to FIG. 6, a second embodiment of a feed regulator clamp 100 is disclosed in which the flat leaf spring 96 is replaced with an extension spring 102 connected to the sewing machine bed and to the clamp by eyelets 104 to bias the clamp in a counterclockwise direction as in the previous embodiment. The feed regulator clamp 100 might also have its pivot rod 81 retained in a groove 90 by the force of the coil spring 102, and this arrangement has the same advantages as the prior embodiment, i.e. no adjustment is necessary and the clamp is self retaining.

What I claim is:

1. A work feed system for a sewing machine having a frame including a work supporting bed housing said feed system, a throat plate carried by said work supporting bed and having a feed dog accommodating slot therein, said feed system including a feed dog having a work supporting rib arranged in said feed dog accommodating slot of said throat plate, a feed shaft, a feed lift cam supported on said feed shaft for alternately raising and lowering said feed dog to and from a work advancing position with said work supporting rib extending through said feed dog accommodating slot, a feed regulator shaft, a regulator affixed to said feed regulator shaft for selectively varying the direction and rate of work advance movement, means for rotating said regulator shaft for selective variation of the direction and rate of said work advance movement, the improvement comprising a radially functioning camming device on said feed shaft operating in synchronism with said feed lift cam;

a brake member affixed to said feed regulator shaft;

a bell crank pivotally supported in said work supporting bed having a first arm thereof in contact with said camming device and a second arm thereof in selective contact with said brake member for inhibiting movement thereof as permitted by said camming device; and, means for urging said bell crank in a direction to have the second arm thereof in contact with said brake member.

2. A work feeding system as claimed in claim 1 wherein said improvement further comprises a pivot rod for pivotally supporting said bell crank extending from both sides thereof;

said work supporting bed being fashioned with a "U"shaped boss for receiving said bell crank, said boss having an aligned groove in the legs thereof for receiving said pivot rod; and, means for retaining said pivot rod in said grooves.

3. A work feeding system as claimed in claim 2 wherein said retaining means is implemented by a "U" shaped spring fastened to said boss with the legs thereof extending over said grooves to retain said pivot rod therein and wherein said means for urging said bell crank is implemented by a pin spaced from said pivot rod and also extending from both sides of said bell crank, said "U" shaped spring having the legs thereof also extending over said pins to urge said bell crank in a direction to have said second arm thereof in contact with said brake member.

4. A work feeding system as claimed in claim 2 wherein said means for retaining said pivot rod in said grooves and said means for urging said bell crank is implemented by an extension spring extending from said work supporting bed to said bell crank in a location to retain said pivot rod in said grooves and to urge said bell crank in a direction to have said second arm thereof in contact with said brake member.

* * * * *